United States Patent [19]

Wade

[11] 4,404,980

[45] Sep. 20, 1983

[54] ARCHED SUPPORT STRUCTURE WITH COVER

[75] Inventor: Mark W. Wade, Boynton Beach, Fla.

[73] Assignee: James Nemec, West Palm Beach, Fla.

[21] Appl. No.: 192,189

[22] Filed: Sep. 30, 1980

[51] Int. Cl.[3] ..... A45F 1/16

[52] U.S. Cl. ..... 135/102; 135/97; 135/117; 135/118

[58] Field of Search ..... 135/1-4, 135/15 PE, DIG. 1, 97, 117, 118, 102

[56] References Cited

U.S. PATENT DOCUMENTS

| | | | |
|---|---|---|---|
| 1,650,111 | 11/1927 | Byne | 135/DIG. 1 |
| 2,817,344 | 12/1957 | Teeter | 135/DIG. 1 |
| 2,856,941 | 10/1958 | O'Neal | 135/DIG. 1 |
| 2,953,145 | 9/1960 | Moss et al. | 135/1 R |
| 3,008,557 | 11/1961 | Clevett | 135/15 PE |
| 3,051,185 | 8/1962 | Reynolds | 135/DIG. 1 |
| 3,114,376 | 12/1963 | Rexroat et al. | 135/1 R |
| 3,223,098 | 12/1965 | Dole | 135/3 E |
| 3,424,179 | 1/1969 | Minot | 135/3 R |
| 3,461,890 | 8/1969 | Goodrich | 135/DIG. 1 |
| 3,496,686 | 2/1970 | Bird | 135/DIG. 1 |
| 3,625,235 | 12/1971 | Gorgichuk | 135/1 R |
| 3,788,335 | 1/1974 | Hemmelsbach | 135/15 PE |
| 3,798,851 | 3/1974 | Utahara | 135/DIG. 1 |
| 3,800,468 | 4/1974 | de Graff | 135/DIG. 1 |
| 4,091,584 | 5/1978 | Brown | 135/1 R X |
| 4,098,281 | 7/1978 | Bonfilio | 135/4 R |
| 4,116,206 | 9/1978 | Warner et al. | 135/15 PE |
| 4,144,899 | 3/1979 | Kays | 135/15 PE |

FOREIGN PATENT DOCUMENTS

| | | | |
|---|---|---|---|
| 1195460 | 6/1965 | Fed. Rep. of Germany | 135/DIG. 1 |
| 7708497 | 2/1978 | Netherlands | 135/3 E |
| 809621 | 2/1959 | United Kingdom | 135/DIG. 1 |
| 1281236 | 7/1972 | United Kingdom | 52/2 |

*Primary Examiner*—J. Karl Bell

*Attorney, Agent, or Firm*—Harvey B. Jacobson

[57] ABSTRACT

A covered structure is formed in an arched shape and utilizes PVC pipe which is slidable through sleeves electrically welded to a cover. The PVC pipe is bent into an arched shape and is attached to spreader bars which serve as the ground contacting portion of the structure. Fiberglass rods are inserted within the arched PVC pipe so as to both strengthen and define the arch, and water bags and stakes may be attached to the spreader bar, which is also constructed of PVC pipe, so as to anchor the structure to the ground. This construction provides for a flexible covered structure which will not be destroyed by external forces, such as wind, rain, etc., since only resilient materials are used in its construction. Additionally, building code requirements which relate to the method of attachment of a structure to the ground are not applicable since a direct attachment between the structure and the ground is not required.

6 Claims, 15 Drawing Figures

FIG. 3
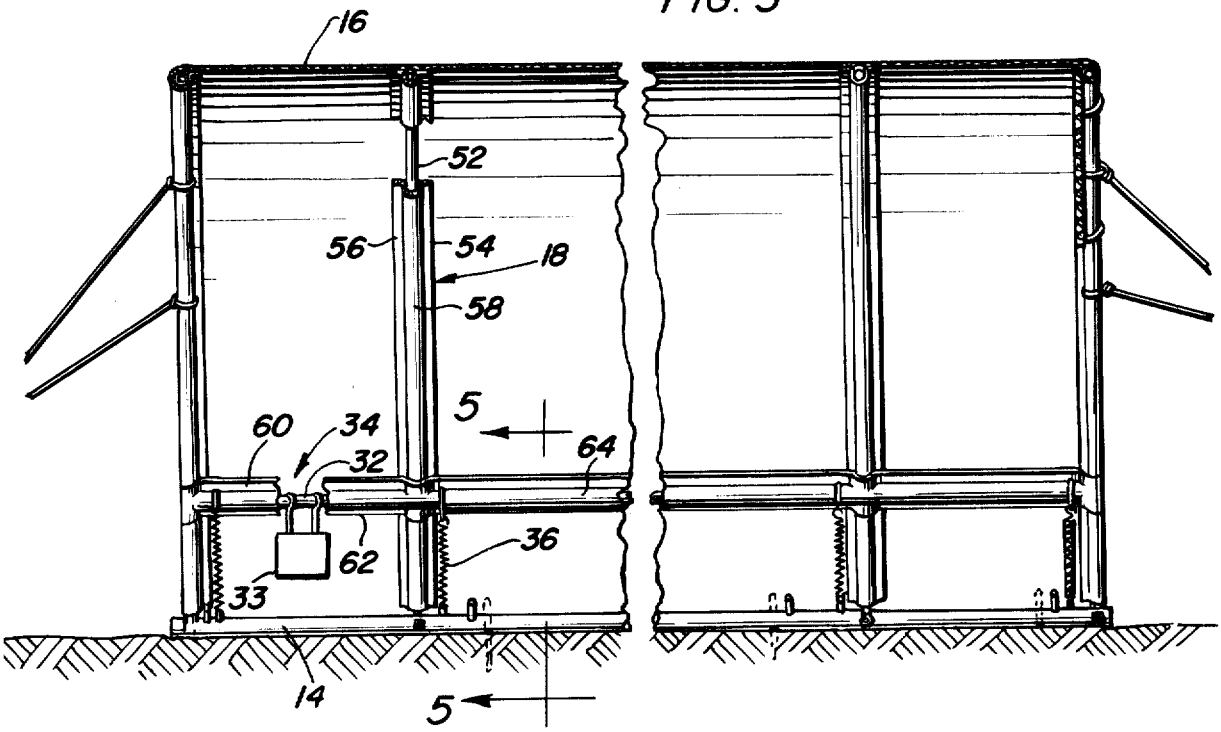
FIG. 5
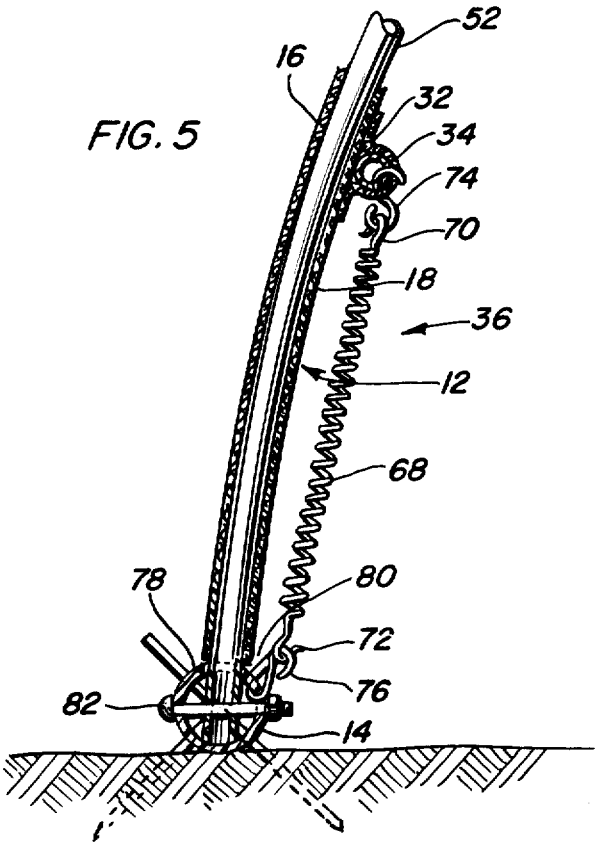
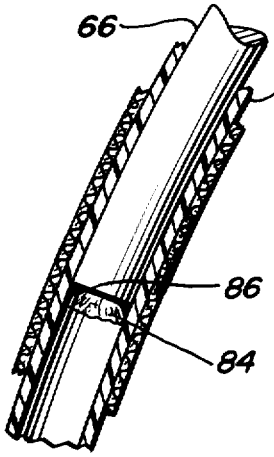
FIG. 6
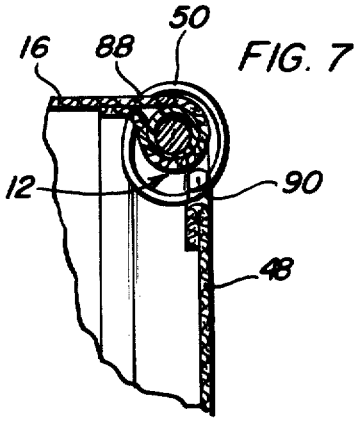
FIG. 7

ARCHED SUPPORT STRUCTURE WITH COVER

BACKGROUND OF THE INVENTION

1. Field of the Invention

The present invention relates to a covered structure and more particularly pertains to a flexible arched covering apparatus which is constructed solely of flexible materials and which need not be directly attached to a surface.

2. Description of the Prior Art

There has been a long-felt heretofore unfilled need for an arched covering structure which affords flexiblity in construction and aesthetic expression, and which further embodies simplicity, economy and versatility in use. The high cost of construction of permanent covering structures, as well as semi-permanent covering structures, in addition to the general inadequacy of portable-type building structures of the types heretofore known, has constituted a significant obstacle in the progress and expansion of many industries and other activities reliant on one form or another of shelter protection from the outside elements.

In this respect, there have been a number of attempts to utilize arched support covering apparatuses for meeting a demand for shelters in as economical a manner as possible. However, all of these structures have typically required at least some form of expensive construction for effecting a direct attachment of the arched supports to a surface, as well as the use of a plurality of complicated fittings and supports in order to construct the covering arch. Such a permanent attachment between an arched support and a surface has generally been required in the prior art devices due to their inflexible construction, thereby making them very vulnerable to damage from external forces such as wind. As such, a permanent attachment of an arched support structure to a surface added strength to the covering apparatus so as to effectively offset some of the consequences of the external forces of nature to which a covering apparatus might be exposed.

For example, U.S. Pat. No. 3,855,643, issued to Sanford et al on Dec. 24, 1974, discloses an arched support covering apparatus for a swimming pool which includes a skeleton frame mounted over a pool and having a flexible plastic sheet disposed thereover. The cover is held in place by elastic cords or cables attached to pin assemblies in a deck or the like, while the skeleton frame is firmly and permanently mounted into the concrete sides of the swimming pool to thereby impart the required support strength associated with a substantially inflexible covering apparatus. Similarly, U.S. Pat. No. 4,121,604, issued to Rain on Oct. 24, 1978, discloses a more recent attempt at constructing a modular arched arrangement for providing a shelter. In this connection, the Rain covering apparatus also makes use of arched support rods which are securely and permanently mounted in concrete so as to effect the minimum required strength for support of the structure. Further, the Rain apparatus utilizes a plurality of complex and difficult to assemble fittings for holding the support rods in place.

There have been variations in construction of arched support covering apparatuses which differ from the above-discussed covering devices relying upon the implantation of individual arched support rods into concrete or the like. For example, U.S. Pat. No. 3,798,851, issued to Utahara on Mar. 26, 1974, discloses an arched support structure which may be assembled in its totality prior to a permanent attachment to a surface. In this regard, the Utahara device includes the use of many complex fittings and support rods, as well as a plurality of guy wires attached between the arched support to maintain their shape prior to a permanent fixation of the structure to a surface. Again, as with the above-discussed devices, the apparatus of Utahara must eventually be permanently attached to the ground since the structure is of such an inflexible nature as to be impractical for use without a permanent attachment. U.S. Pat. No. 3,892,094, issued to Spray on July 1, 1975, is further illustrative of attempts by inventors to simplify the construction of rigid shelters having flexible sheathing attached thereto. In this connection, the Spray apparatus utilizes four or more posts securely and permanently positioned within a surface to which may then be bolted a plurality of arched support rods. Again, the structure is most complex and includes many ancillary braces and supports to maintain the arched configuration.

In all of the above-discussed patents, the arched support structures are constructed independently of the flexible sheathings or coverings associated therewith and are permanently attached to support surfaces. In this regard, the sheathings may be removed from the support structures; however, the support structures themselves may be moved only at great expense and difficulty. Further, the flexible sheathings overlie the support structures and are subject to being torn therefrom in the event of high winds and similar disturbances. Accordingly, it can be appreciated that these permanently positioned structures are substantially expensive and difficult to build, and do not afford a lot of protection to a flexible sheath which may be ripped therefrom as a result of violent external conditions. Of interest also are U.S. Pat. Nos. C. F. Huddle, 3,215,153, and W. W. Bird et al, 3,240,217.

The inadequacies and disadvantages of the above devices have been long recognized by those working in the field of covered shelters, and at least one attempt has been made to overcome some of these problems as illustrated in U.S. Pat. No. 3,899,854, issued to Huddle on Aug. 19, 1975. In this connection, the Huddle apparatus discloses a somewhat portable arched covering structure which is held in the desired shape through the use of fittings, braces and guy wires and to which may be attached a flexible covering membrane. The membrane is positioned within the structure formed by the arched support, i.e., the frame is external to the membrane, as opposed to the coverings overlying the frames as priorly discussed. Effectively then, Huddle has at least recognized a need for portable shelters, although no attempt has been made to provide an arched support structure which is integrally constructed with a cover or which utilizes a minimum of fittings and support braces in the construction thereof.

SUMMARY OF THE INVENTION

The general purpose of this invention, which will be described subsequently in greater detail, is to provide an arched support covering apparatus that has all of the advantages of similarly employed prior art devices and has none of the above-described disadvantages. To attain this, the present invention provides for an arched support structure and cover which is constructed essentially entirely of PVC pipe, fiberglass rods and flexible coverings, all of which are fixedly attached together. In this connection, the covering support structure of the present invention utilizes PVC pipe having fiberglass rods provided therein, so as to improve strength characteristics and to support an arch shape, and these PVC pipes are then inserted through sleeves which are formed of a material electrically welded to a flexible covering thereby to securely attach the flexible covering to the arched supports. The PVC pipe forming the arched support members are then fixedly attached at their ends to orthogonally positioned PVC pipe which serves as spreader bars designed for direct contact with a surface.

A stretch effect may be provided to the flexible covering by providing for hold-down straps attachable between the covering and the ground or spreader bar, while water bags attached to the ground bar may be provided for anchoring the arched support structure firmly to a surface without a need of a direct connection means between the support structure and the surface.

In the various embodiments illustrated in the drawings, it will be noted that the present invention envisions the use of the arched support structures in combination with flexible coverings having clear plastic windows provided therein, as well as in a variety of different shapes such as igloos, cabanas, and the like. Further, the present invention may be constructed with wheels or track guide members so that the same may be easily transported to a variety of different positions. In any respect, it can be appreciated that the lightweight construction of the arched support structure allows an easy transporting thereof.

It is therefore an object of the present invention to provide a portable shelter having all of the advantages and none of the disadvantages of prior art shelters.

Another object of the present invention is the provision of a portable shelter which is of a lightweight and durable construction.

A further object of the present invention is the provision of a portable shelter that may be economically and easily manufactured.

Still another object of the present invention is the provision of a portable shelter which is designed with sufficient flexibility to withstand destructive external forces.

Yet another object of the present invention is the provision of a shelter which is portable so as to afford an easy transportation thereof to desired locations.

A still further object of the present invention is the provision of a portable shelter which may be utilized without a requirement of permanently and directly attaching the same to a surface.

Even another object of the present invention is the provision of a portable shelter which utilizes a flexible cover fixedly to an arched skeleton frame whereby a one-step disassembly of both the cover and frame may be effected.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a longitudinal cross sectional view taken along the line 3—3 of FIG. 1.

FIG. 5 is a detailed structural view in cross section taken along the line 5—5 of FIG. 3.

FIG. 6 is a detailed structural view, partly in cross section, illustrating the positioning of a fiberglass rod within a section of PVC pipe forming an arched support.

FIG. 7 is a detailed structural view in cross section taken along the line 7—7 of FIG. 2.

FIG. 11 illustrates how a plurality of different shapes of the present invention may be joined together to effectively cover a swimming pool or the like.

DESCRIPTION OF THE PREFERRED EMBODIMENT

Figure 1:
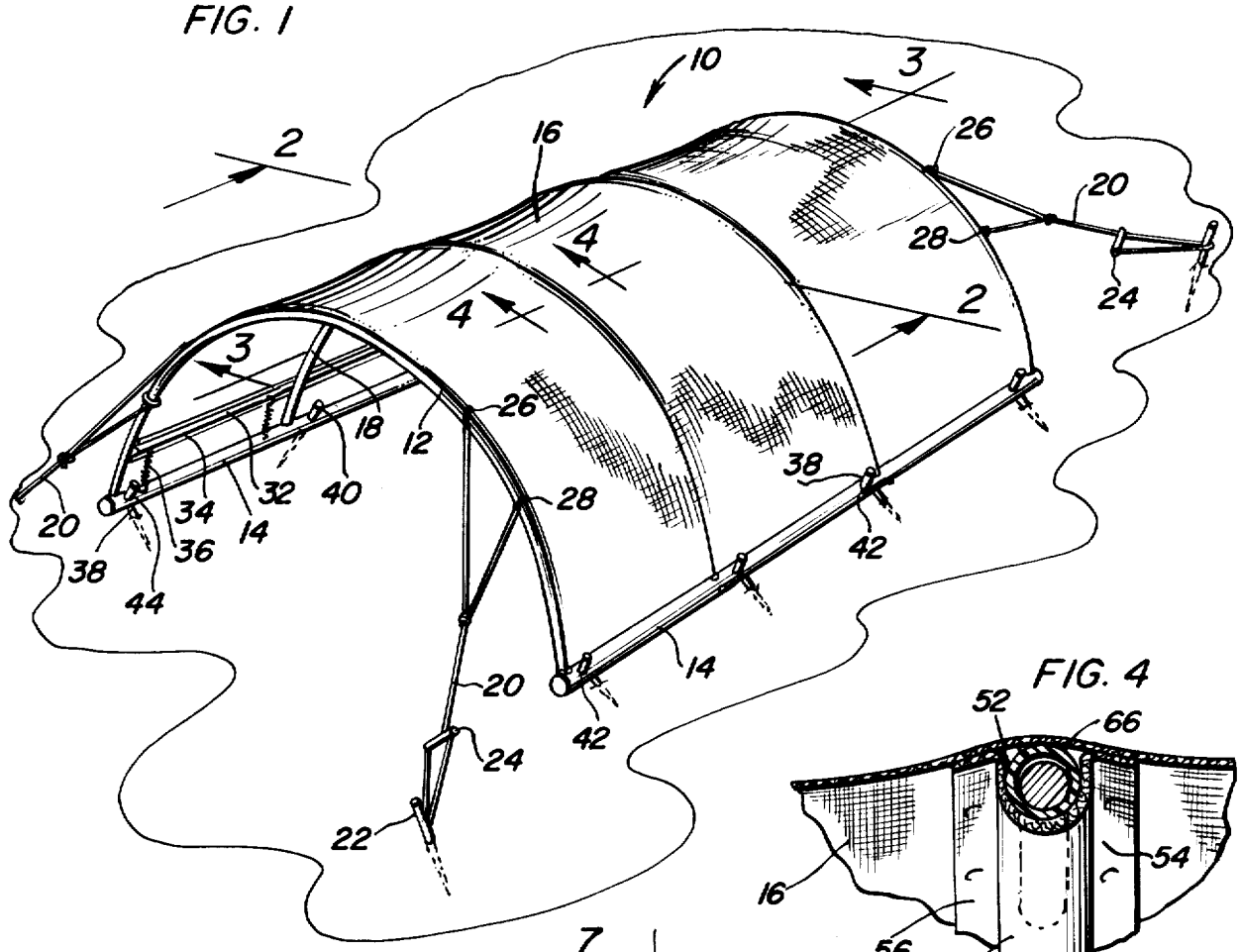
FIG. 1 is a perspective view illustrating one embodiment of the portable shelter forming the present invention.

Referring now to the drawings and, in particular, to FIG. 1 there is disclosed one embodiment of the portable shelter forming the present invention and which is generally designated by the reference numeral 10. In this connection, the portable shelter 10 includes a plurality of arched support members 12 being attached at ends thereof to ground support or spreader bars 14 and having a flexible covering 16 fixedly attached thereto. As can be partially ascertained with reference to this figure, the arched support members 12 are contained within wide seams or sleeves 18 which are formed of a piece of flexible covering electrically fused or otherwise secured to the covering 16 so as to provide a conduit or sleeve for insertion of a piece of PVC pipe therein. Further, if desired, the portable shelter 10 may be semi-permanently positioned at a particular location through the use of securing ropes 20 connectible between an endmost arched support member 12 and a stake 22 which may be temporarily driven into a surface. In this connection, a tightening adjustment member 24, which is of conventional construction, may be used in combination with the securing rope 20 to thereby facilitate an adjustment of the rope to a desired tension. To facilitate a better securing of the rope 20 to the portable shelter 10, the rope may be conveniently attached to a respective arched support member 12 at a plurality of points, such as points 26, 28. However, it should be noted that it is not really necessary to attach the portable shelter 10 forming the present invention to the ground through the use of stakes 22, since as will be subsequently described, the invention envisions the use of water bags 33 as one method of anchoring the portable shelter in place.

Also illustrated in FIG. 1 is the use of horizontally extending support members 32 which are parallelly aligned with and spaced apart from the spreader bars 14 and which are similarly contained within a sleeve 34 thereby to provide a support surface on the flexible covering 16 to which hold-down straps 36 may be attached. The hold-down straps 36 are connectible between the sleeve 34, with its associated horizontal support member 32, and the respective spreader bars 14 so as to effectively stretch the flexible covering 16 in a desired manner over the arched support members 12.

Further illustrated in FIG. 1 is an additional alternative means of temporarily holding the portable shelter 10 in a desired position, such means comprising the use of stakes 38 positioned exteriorly of the flexible covering 16 and stakes 40 positioned interiorly of the flexible covering. The stakes 38 are insertable through apertures 42 provided in the spreader bars 14, while similarly, the stakes 40 are positioned through apertures 44, such apertures 42, 44 extending entirely through the spreader bars and being in a proximate relationship to one another so that the respective stakes 38, 40 form a cross pattern upon insertion therethrough into the ground or similar surface.

Figure 2:
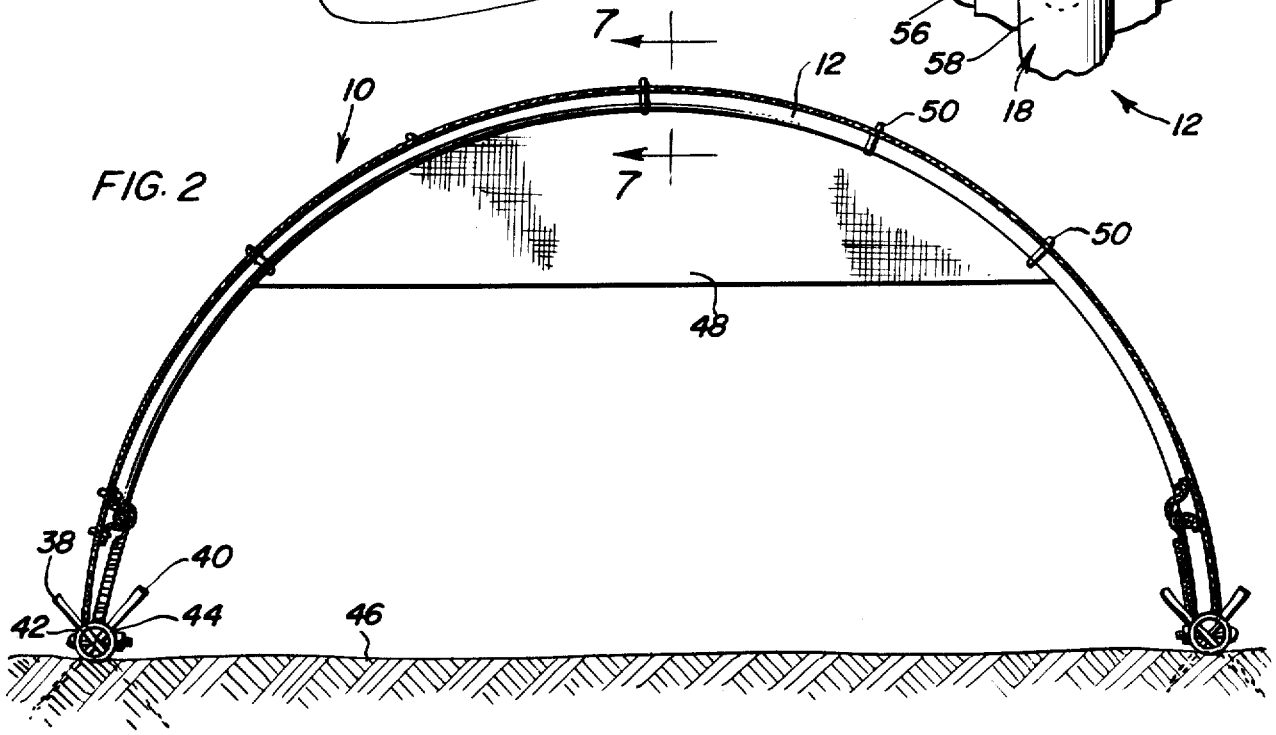
FIG. 2 is a transverse cross sectional view taken along the line 2—2 of FIG. 1.

Referring now to FIG. 2, it can be seen that the stakes 38, 40 extend completely through the spreader bar 14 in the manner afore-described so as to present a wedged locking action of the spreader bars with respect to the ground 46. As can be appreciated, this configuration prevents movement of the spreader bars 14 in any direction across the ground surface 46 while at the same time the stakes 38, 40 may be easily removed therefrom so as to permit a transporting of the portable shelter 10. Additionally illustrated with respect to this figure is the fact that the flexible covering 16 may include a downwardly extending portion 48 which serves to partially cover an open end of the portable shelter. The portion 48 further operates to provide protection in the shelter 10 from the elements, as well as to add tensioning support for holding the arched support members 12 in their curvilinear shape. Futher illustrated is an optional use of hose clamps 50 which may be circumferentially positioned about an arched support member 12 in a manner to effectively compress the flexible covering 16 thereto.

With reference to FIG. 3, which is a cross sectional view taken along the line 3—3 of FIG. 1, it can be ascertained that an arched support member 12 is effectively comprised of a piece of PVC pipe 52 positioned within the sleeves 18. In this connection, the sleeves 18 are illustrated as being electrically fused to the flexible covering 16 by means of a pair of spaced apart parallelly aligned seams 54, 56 thereby to create a tubular-shaped conduit 58 into which the PVC pipe 52 may be inserted into a slidable engagement therewith. Similarly, the horizontal sleeves 34 are formed from a piece of material having seams 60, 62 electrically fused to the flexible covering 16 in a manner forming a conduit 64 thereby to permit a retention of the PVC pipe or support member 32 therein. This figure further serves to illustrate the attachment of the hold-down straps 36 between the support members 32 and the spreader bars 14. Additionally, an optional water bag 33 is shown attached to the support member 32, such water bag serving as a weight for securing the shelter 10 in position either with or in lieu of other hold-down means such as stakes 38, 40 and lines 20. It is to be understood that the water bags 33 may be attached at any convenient point of the shelter 10 which would facilitate a holding thereof, and could, if desired, simply be detachably positioned against the spreaders 14.

Figure 4:
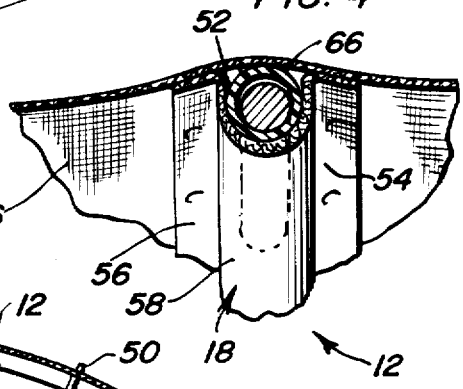
FIG. 4 is a detailed structural view in cross section taken along the line 4—4 of FIG. 1.

Referring now to FIG. 4, which is a cross-sectional view taken along the line 4—4 of FIG. 1, a further understanding of the specific construction of the arched support members 12 can be ascertained. In this respect, an arch sleeve 18 is illustrated as being comprised of seams 54, 56 electrically fused to the flexible covering 16 in a spaced apart manner so as to form the afore-described tubular conduit 58 thereby to permit an insertion of the PVC pipe 52 therein. Further, it can be seen that a fiberglass rod 66 is contained within the PVC pipe 52 so as to keep the pipe from peaking and to flatten the arch thereof. The fiberglass rod 66 is slidably inserted within the PVC pipe 52 and extends substantially over the entire length thereof, such rod being secured therein in a manner to be subsequently described.

With reference to FIG. 5, a further discussion of the hold-down straps 36 utilized in conjunction with the present invention is provided. In this respect, a hold-down strap 36 is shown as being formed by a spring member 68 which has hooks 70, 72 integrally formed on the ends thereof, such hooks 70, 72 being respectively engageable with S-shaped hooks 74, 76. As shown, the S-shaped hook 74 is further engageable with the horizontal support member 32, while the S-shaped hook 76 is engageable with the spreader bar 14. Effectively then, the hold-down strap 36 stretches the flexible covering 16 through a pulling on the support member 32 positioned in the sleeve 34 downwardly towards the spreader bar 14.

FIG. 5 further illustrates the method of attaching the arched support members 12 to the spreader bars 14. In this regard, the spreader bar 14 is provided with an aperture 78 which is of a greater diameter than the PVC pipe 52 positioned within the sleeve 18. As such, the PVC pipe 52 is permitted to extend outwardly from a bottom portion 80 of the sleeve 18 and into the spreader bar 14 through the aperture 78. A connection means, such as bolt 82, may then be connectibly inserted both through the spreader bar 14 and the PVC pipe 52 in the manner illustrated so as to secure the pipe to the spreader bar.

FIG. 6 illustrates a preferred manner of securing a fiberglass rod 66 within a piece of PVC pipe 52 so as to fixedly retain the same therein. In this connection, a caulking material 84 may be inserted into the PVC pipe 52 so as to effectively contact the inside surface of the pipe and a free end 86 of the fiberglass rod 66. If such caulking material 84 is used at both ends of a fiberglass rod 66 within a piece of PVC pipe 52, it can be appreciated the the fiberglass rod will be prevented from coming out of the pipe.

FIG. 7, which is a cross sectional view looking along the line 7—7 of FIG. 2, illustrates how a hose clamp 50 or some similar member constructed in the form of a ring may be utilized to effectively hold the covering including its downwardly extending portion 48 to the cover 16 if these two covers are fabricated in a separable manner. In this respect, the hose clamp 50 is positionable about an arched support member 12 in the manner illustrated and may be tightened to a desired extent to effect a good connection between the coverings 16, 48. As is apparent, the respective coverings 16,

48 must be provided with apertures 88, 90, respectively, through which the hose clamp 50 can be inserted.

Figure 8:
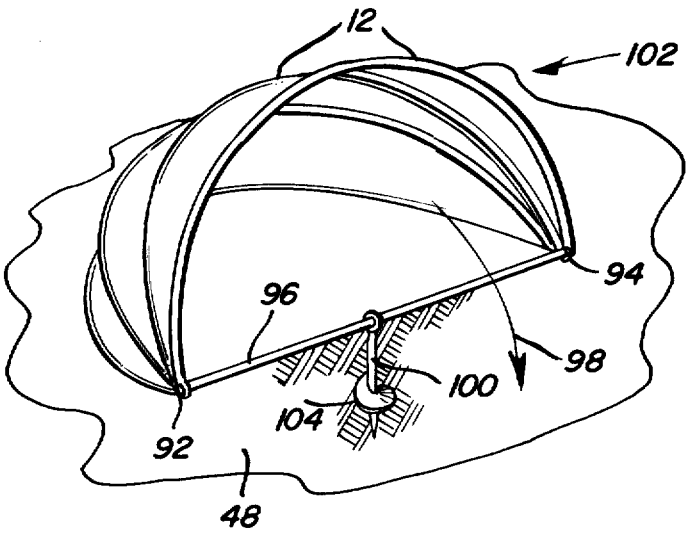
FIG. 8 is a perspective view of an embodiment of the present invention formed in the shape of a cabana.

FIG. 8 illustrates the present invention in a construction whereby the arched support members 12 are pivotally connected to each other at common points, such as the ends 92, 94 of rod 96. As can be appreciated, such a manner of connecting the arched support members 12 results in the portable shelter 10 being formed in the shape of a cabana generally designated by the numeral 102. This construction permits the cabana 102 to be easily collapsed since the arched support members 12 may be separately pivoted about the respective pivot points 92, 94 so as to come into an abutting relationship with each other. Further, the cabana 102 may be pivoted about the rod 96 in the direction of the arrow 98 so as to effectively reverse the opening end of the cabana thus permitting access to the same from an opposite direction. Additionally, an anchoring means 100 may be fixedly attached to the rod 96 and inserted into the ground 48 so as to lockingly position the cabana 102 at a desired location. This anchoring means 10 may be of a screw-type having a thread portion 104 integrally attached thereto whereby the cabana 102 may be literally screwed into the ground to anchor the same into position. In this respect, the rod 96 may be rotated about the horizontal axis of the anchoring means 100 while such axis and its associated anchoring means is positioned in contact with and in a direction orthogonal to the plane defining the surface of the ground 48.

Figure 10:
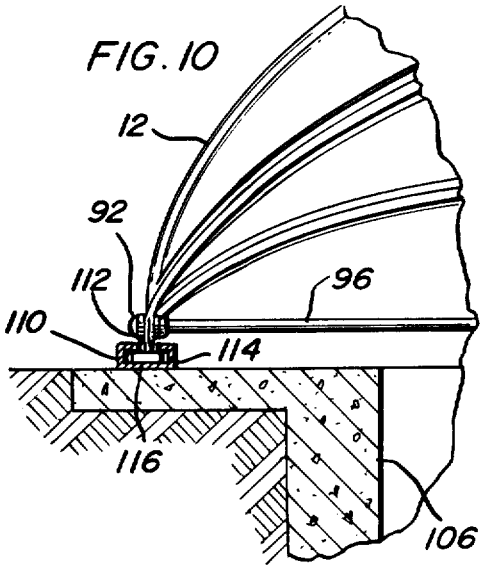
FIG. 10 is a detailed structural view of the guide track taken along the line 10—10 of FIG. 9.
Figure 9:
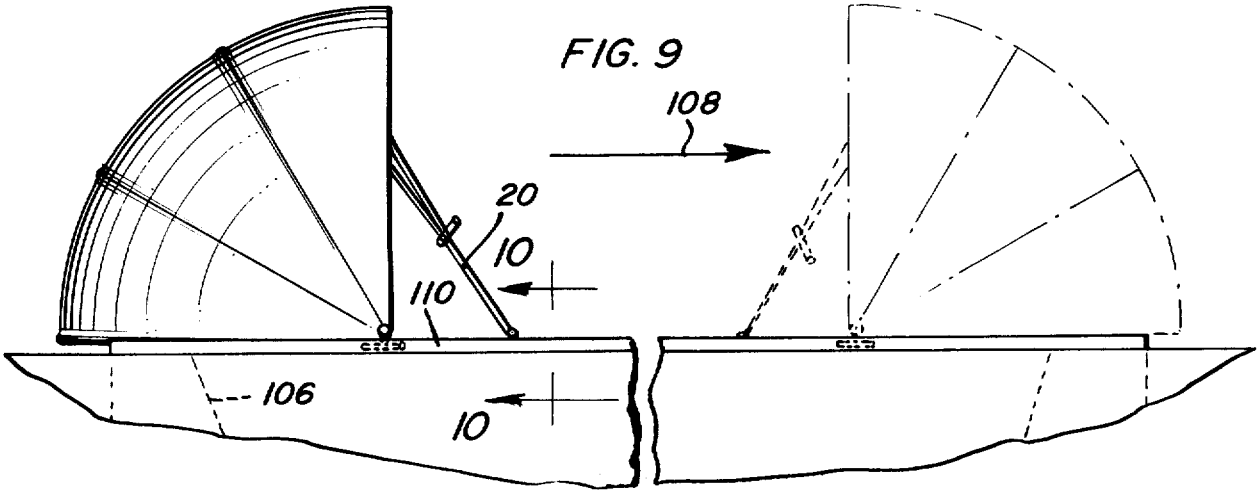
FIG. 9 illustrates how the present invention may be operably associated with a guide track to facilitate easy movement thereof.

FIG. 9 illustrates a preferred use of the cabana 102 whereby the same may be positioned over a swimming pool 106 to respectively shade one end or the other thereof or an adjacent deck area. In this connection, the cabana 102 may use securing ropes 20 to hold the same in position and may be movable along the length of the pool 106 in the direction of the arrow 108 through the use of tracks 110. With particular reference to FIG. 10, which is a cross sectional view looking along the line 10—10 of FIG. 9, it can be seen that the tracks 110 are of a hollow rectangular configuration having a slot 112 extending along the length of the track member 110 and being positioned at a topmost portion thereof so as to permit a communication with the interior hollow portion 114 of the track. Attached to the rod 96 at the point of pivotal connection 92 is a downwardly extending T-shaped member 116 which is slidably engageable with the track 110. In this respect, the T-shaped member 116 is slidable in the longitudinal direction within the hollow portion 114 of the track 110 and is prevented from becoming disengaged therefrom due to the slot 112 being of a more narrow construction than the member 116. As such, a back-and-forth movement of the cabana 102 along the track 110 is made possible so as to allow the positioning of the cabana at any desired point along the length of swimming pool 106. Optionally, though not illustrated, it is envisioned that wheels could be utilized in place of the track 110, such wheels being provided on members which are in turn pivotable about the pivot points 92, 94 thereby to selectively cause engagement of the wheels with the ground 48 to effect a movement of the cabana 102. In other words, the wheels could be rotated into engagement with ground 48 so as to move a cabana 102 in a desired direction, and then could be pivoted back out of engagement with the ground once the cabana is located where desired.

Figure 11:
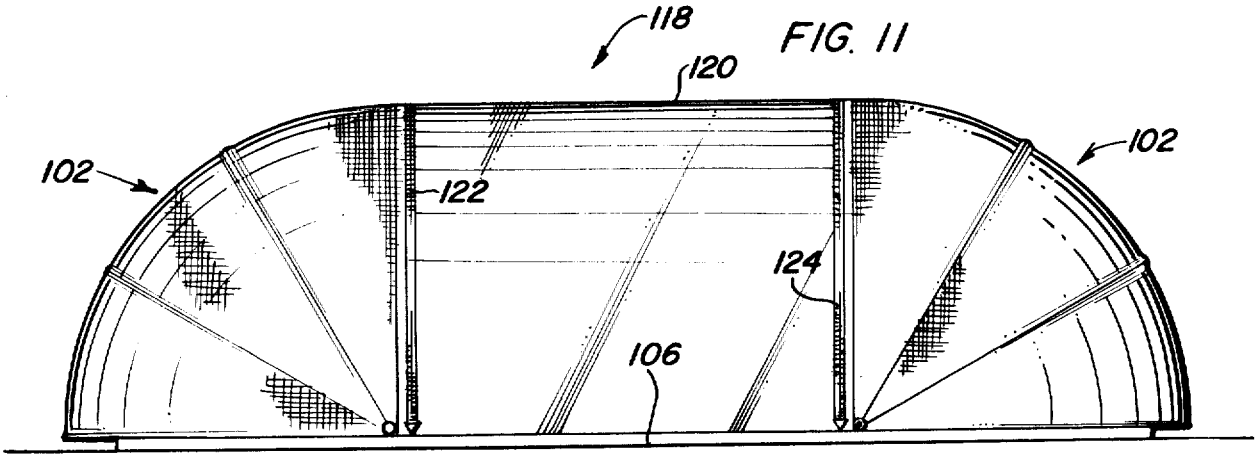

FIG. 11 illustrates a modified version of a pool cover 118 which utilizes a pair of cabanas 102, as illustrated in FIG. 8, each of which is positioned at respective ends of a swimming pool 106 and each being connected to an intermediate portion 120 constructed in the shape of the portable shelter 10 illustrated in FIG. 1. In this respect, it may not be necessary to utilize any additional arched support members 12 or even a spreader bar 14, but rather sufficient support may exist by just connecting the intermediate portion 120 to the respective open ends of the two cabanas 102. It is envisioned that an effective connection between the intermediate portion 120 and the two cabanas 102 could be effected through the use of zippers 122, 124. The length of the intermediate portion 120 of course may be varied so that the pool cover 118 may be constructed to effectively cover and extend over substantially the entire length of a swimming pool 106.

Figure 12:
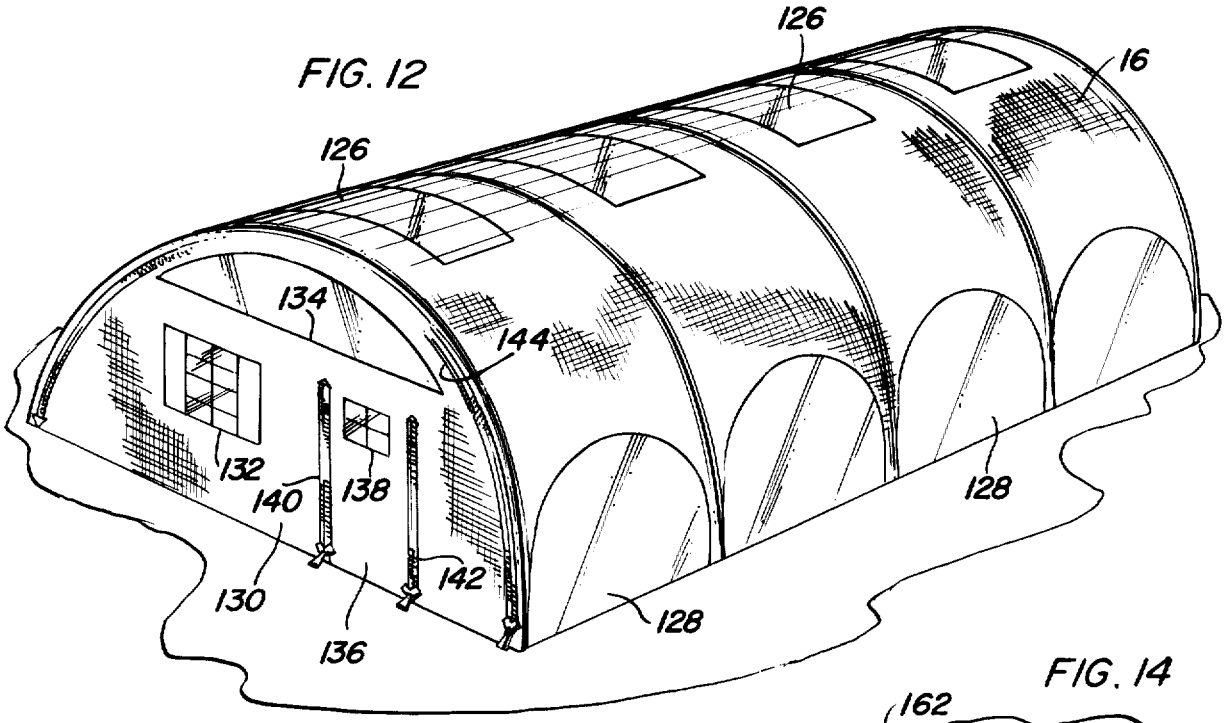
FIG. 12 further illustrates the use of the present invention in a manner to include vinyl windows, skylights and zip doors.

FIGS. 12 through 15 illustrate even further slightly modified constructions of the present invention which illustrate the flexibility thereof so as to achieve a number of different desired shapes and uses. In this ragard, FIG. 12 illustrates the embodiment of FIG. 1 but designed to include a plurality of skylights 126 and see-through side panels or screens 128. The skylights 126 should be constructed of a flexible see-through material such as a clear vinyl plastic, while the same material may be utilized in the construction of the side panels 128 or alternatively, any flexible screening could be used for the side panels as long as the same is conformable with and attachable to the flexible covering 16. Further, the embodiment of FIG. 12 illustrates the use of an end wall 130 having windows 132, 134 positioned therein, such windows being preferably constructed of the same clear see-though plastic or screen, and a door 136 having a flexible window 138 therein and being defined as well by a pair of zippers 140, 142. The entire end wall 130 might be removable from the embodiment of FIG. 12 through the use of a connection means such as a zipper 144.

Figure 13:
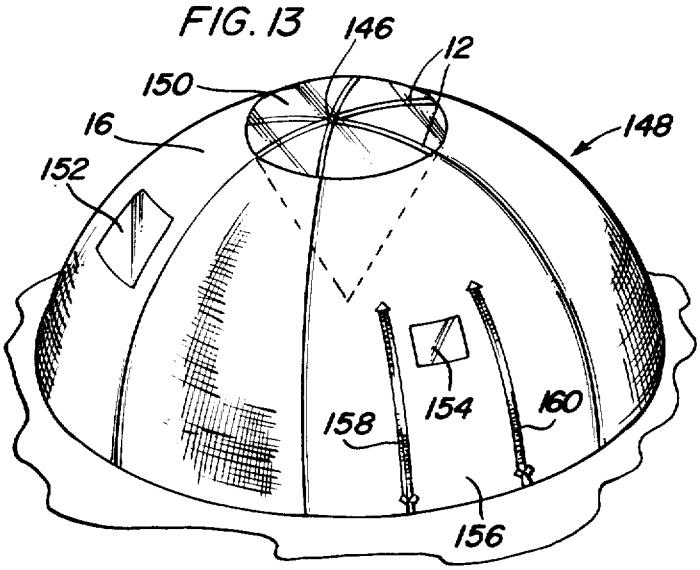
FIG. 13 illustrates a construction of the present invention in an igloo shape.

In FIG. 13, there is shown even a further modified construction wherein a plurality of arched support members 12 are positioned in a star pattern so as to have a common connection or cross-over point 146 at a topmost portion thereof so as to define an igloo 148. If desired, the flexible covering 16 stretched over the igloo 148 may be provided with a skylight 150 constructed in the afore-described manner. Further, windows 152, 154 may be provided, as well as door 156 having zippers 158, 160 defining the same.

Figure 14:
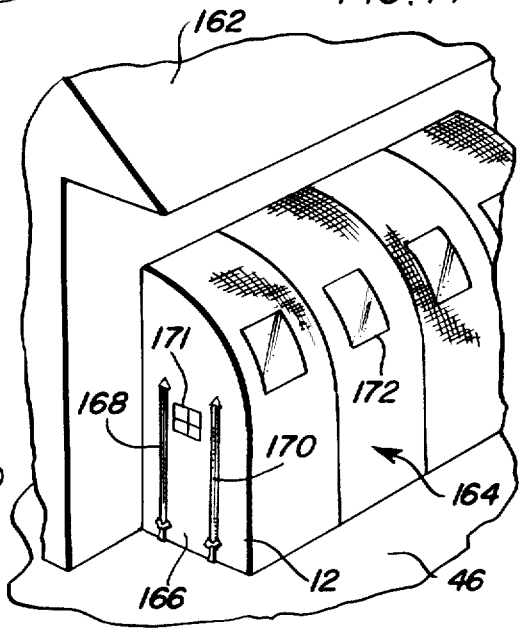
FIG. 14 illustrates a use of the present invention whereby it serves as an extension of a permanent structure.

FIG. 14 illustrates another embodiment which utilizes arched support members 12 so shaped to have one free end thereof abuttable with the ground 46 and the other free end attachable to a permanent structure such as a house 162. As such, this half Quonset-shaped construction or lean-to, as designated by the reference numeral 164, may serve as an extension of a dewlling 162 to thereby add additional living space thereto. Again, a door 166 may be provided, such door having zippers 168, 170 and flexible window 171, and flexible windows 172 may also be provided if desired.

Figure 15:
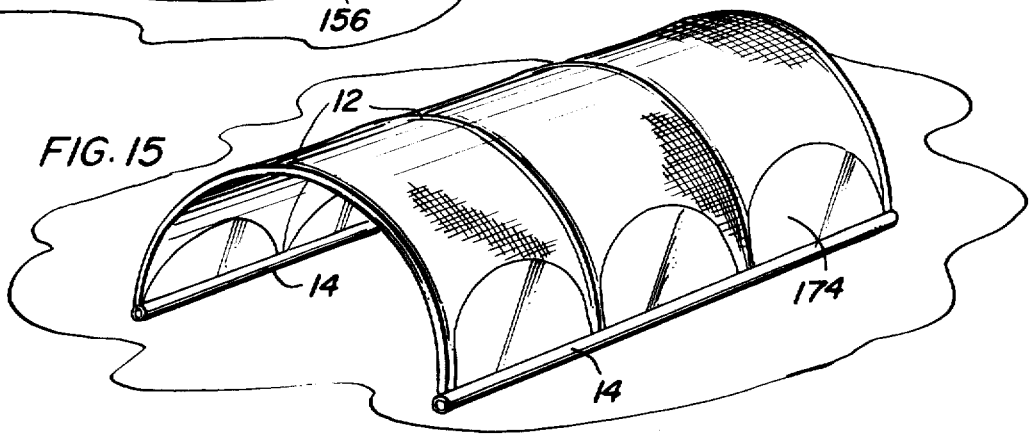
FIG. 15 illustrates in perspective the present invention having windows or screens provided on the sides thereof.

Finally, FIG. 15 illustrates the embodiment of FIG. 1 in a slightly modified form to thus illustrate the use of the arched support members 12 fixedly attached to spreader bars 14 and having a plurality of arched-shaped windows or screens 174 located therebetween. This embodiment represents no more than the embodiment of FIG. 12, but not having the skylights 126 or the end wall 130 attached thereto.

In effect, what has been illustrated by the above description is the fact that the construction of the present invention is very versatile and may be combined to form any number of different shapes. The present invention utilizes no conventional rigid building materials, such as concrete, wood, steel, nails, etc., but rather relies exclusively upon PVC piping, fiber glass rods, nylon cord and vinyl materials so as to obtain the desired internal strength and stress at a revolutionary low cost. Typically, the flexible covering 16 might be vinyl covered nylon with an ultra-violet barrier impregnated therein so that the same can be formulated to last virtually any given length of time and under any type of exposure conditions. Additionally, the covering would be fire-retardant and would be fittable to the frame in such a way as to eliminate all stress points. Notable too is the fact that all sewing has been eliminated thereby to overcome the thread rot problem associated with prior art shelters. Typically, threads rot out in a period of approximately three years, so the seams of the present invention have all been electrically fused so as to eliminate holes and uneven loads of stress which occur from sewing. As such, a completely waterproof skin with no seeping and leaking through stitch holes is provided, with an attendant feature that no seams will pop open due to thread rot. Accordingly, the construction of the present invention requires minimum maintenance (it can be hosed down with water to clean) and it may be typically erected in less than one hour. Further, the disassembly takes about half the time required for assembly, while the entire construction may be rolled up for purposes of storage so as to take up very little space. Further still, no ground preparation is needed, i.e., the portable shelter may be positioned on any uneven surface such as the side of a hill, etc., and the surface on which it is positioned may be of any material, such as cement, asphalt, sand, grass, and the like.

An even further advantage of the construction of the present invention resides in the fact that the non-rigid construction allows the portable shelter to withstand wind and other violent external forces, since the same can resiliently bend in response to forces directed thereagainst. The uses to which the portable shelter can be put are unlimited. In this respect, it is expected that the portable shelter might be used as a carport, a greenhouse, a work area, an inventory cover, a field shelter for animals and crops, a storage cover, a sales room such as used on sidewalk sales, and the like. Further, floodlights might be placed inside since vinyl carries light and at night the complete shelter lights up like a gilded cage for merchandise. As can be appreciated with respect to the many embodiments illustrated herein, the portable shelter can be designed for just about any use that is needed. For example, as above discussed, end walls might be utilized to totally close in a shelter, while windows, screens, awnings or the like can also be installed. Separate buildings may be connected with covered arches or completely covered walkways, and could further include partitions or partial dividers inside. Contrary to the construction of conventional carports or storage buildings, the portable shelter of the present invention is designed to come completely down to the ground for a total cover and protection from salt air, rain, sun and dirt. Of course, it is to be understood that the flexible covering might be totally of the same material and in this respect could be totally a screen, vinyl, glass, or other material construction.

As such, the optimum dimensional relationships for the parts of the invention are deemed readily apparent and obvious to one skilled in the art, and all equivalent relationships to those illustrated in the drawings and described in the specification are intended to be encompassed by the invention, subject only to the limitations specifically appearing in the claims.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable shelter including a plurality of laterally spaced apart and downwardly opening arched plastic pipe members of generally 180° in angular extent, a flexible covering disposed over and supported from said pipe members in arched configuration, the concave inner side of said cover including means defining flexible sleeve portions carried thereby and through which said pipe members extend, the upper portions of said pipe members having longitudinally extending stiffening rods disposed therein to prevent flattening or peaking of the upper portions of said pipe members, means carried by said pipe members preventing longitudinal displacement of said rods in said pipe members, a pair of elongated tubular bars extending between corresponding ends of said pipe members and having upwardly opening apertures formed therein downwardly into which the ends of said pipe members extend with the terminal ends thereof abutted against the inner surface portions of said tubular bars opposite said apertures, ground anchor means supported from said tubular bars for anchoring the latter to the ground, elongated horizontal anchor means carried by said cover, extending transversely of said sleeve portions and spaced above each of said tubular bars, and elongated elastic tension members anchored at one set of corresponding ends to said anchor means adjacent a corresponding sleeve portion and anchored at their other set of corresponding ends to the corresponding tubular bar adjacent the corresponding sleeve portion.

2. The portable shelter of claim 1 wherein said plastic pipe members comprise PVC pipe sections.

3. The portable shelter as defined in claim 1, wherein said tubular bars comprise PVC pipe.

4. The portable shelter as defined in claim 1, wherein said flexible covering is provided with windows to thereby permit light to enter said portable shelter.

5. The portable shelter as defined in claim 1 wherein said flexible covering attached to said plurality of arched pipe members includes at least one downwardly extending portion serving to partially cover an open end of the portable shelter, to provide protection in the portable shelter from the elements, and to add tensioning pipe for holding the arched support members in a curvilinear configuration.

6. The portable shelter as defined in claim 1 wherein hose clamps positioned stably and securely along each of said plurality of arched pipe member effectively compresses the flexible covering thereto.

* * * * *